US005199778A

United States Patent [19]

Aoki et al.

[11] Patent Number: 5,199,778

[45] Date of Patent: Apr. 6, 1993

[54] SHELF APPARATUS FOR A REFRIGERATOR

[75] Inventors: Takashi Aoki; Minoru Yonemura, both of Kusatsu; Hiroji Ito, Omihachiman; Akihiro Shigeta, Fujisawa; Yasuji Imai, Tsuzuki; Tatsuo Miyachi, Koga; Tomoyuki Nishimura; Naoya Ishikawa, both of Kusatsu, all of Japan

[73] Assignee: Matsushita Refrigeration Company, Osaka, Japan

[21] Appl. No.: 642,386

[22] Filed: Jan. 17, 1991

[30] Foreign Application Priority Data

Jan. 19, 1990 [JP] Japan ..... 2-11441
Jan. 19, 1990 [JP] Japan ..... 2-11443
Jan. 19, 1990 [JP] Japan ..... 2-11445

[51] Int. Cl.[5] ..... F25D 11/00

[52] U.S. Cl. ..... 312/408; 312/306; 108/147

[58] Field of Search ..... 312/306, 312, 410, 408; 108/144, 147

[56] References Cited

U.S. PATENT DOCUMENTS

| | | | |
|---|---|---|---|
| 2,841,459 | 7/1958 | Sharpe . | |
| 2,998,290 | 8/1961 | Sharpe et al. . | |
| 3,337,283 | 8/1963 | Schlenkert . | |
| 3,682,801 | 9/1976 | Heidorn et al. | 312/306 |
| 3,982,801 | 9/1976 | Heidorn et al. . | |
| 4,848,091 | 7/1989 | Border . | |
| 4,850,563 | 7/1989 | Grout | 108/147 |

FOREIGN PATENT DOCUMENTS 100611 11/1991 European Pat. Off. .

*Primary Examiner*—Kenneth J. Dorner
*Assistant Examiner*—Gerald A. Anderson
*Attorney, Agent, or Firm*—Ratner & Prestia

[57] ABSTRACT

The present invention relates to a shelf appartus for a refrigerator which raises and lowers a refrigerator's food storage shelves in an analog manner, making it possible to determine the positions of the shelves largely in accordance with the size of food items stored inside the refrigerator. More particularly, racks are provided on the left and right sides of the refrigerator's interior, gears which engage these racks are provided on the shelves of the refrigerator, and the food storage shelves are raised and lowered by rotating these gears.

11 Claims, 9 Drawing Sheets

FIG. 7(a)
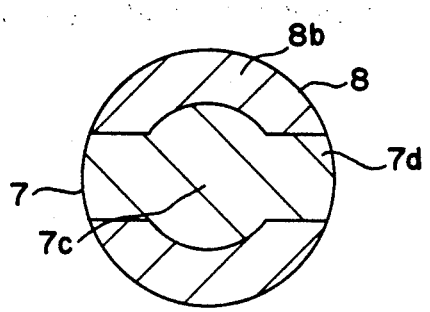
FIG. 7(b)
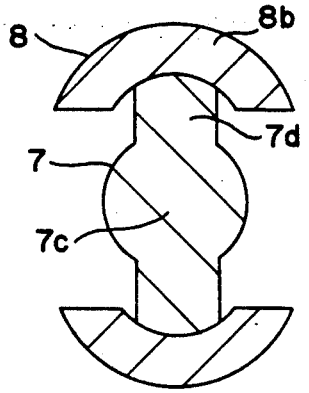
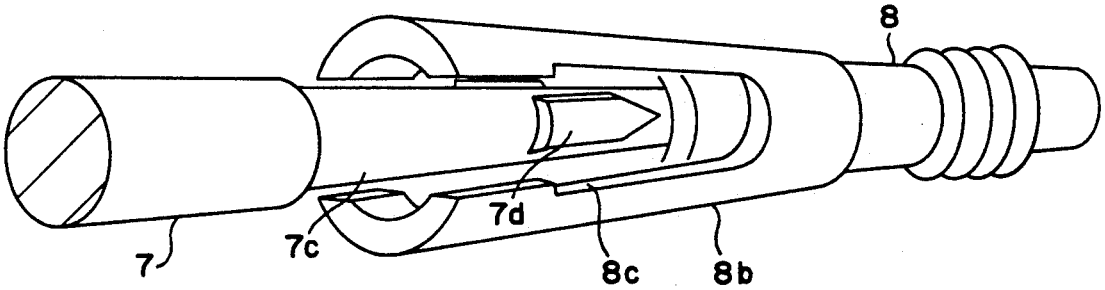
FIG. 8

FIG. 9
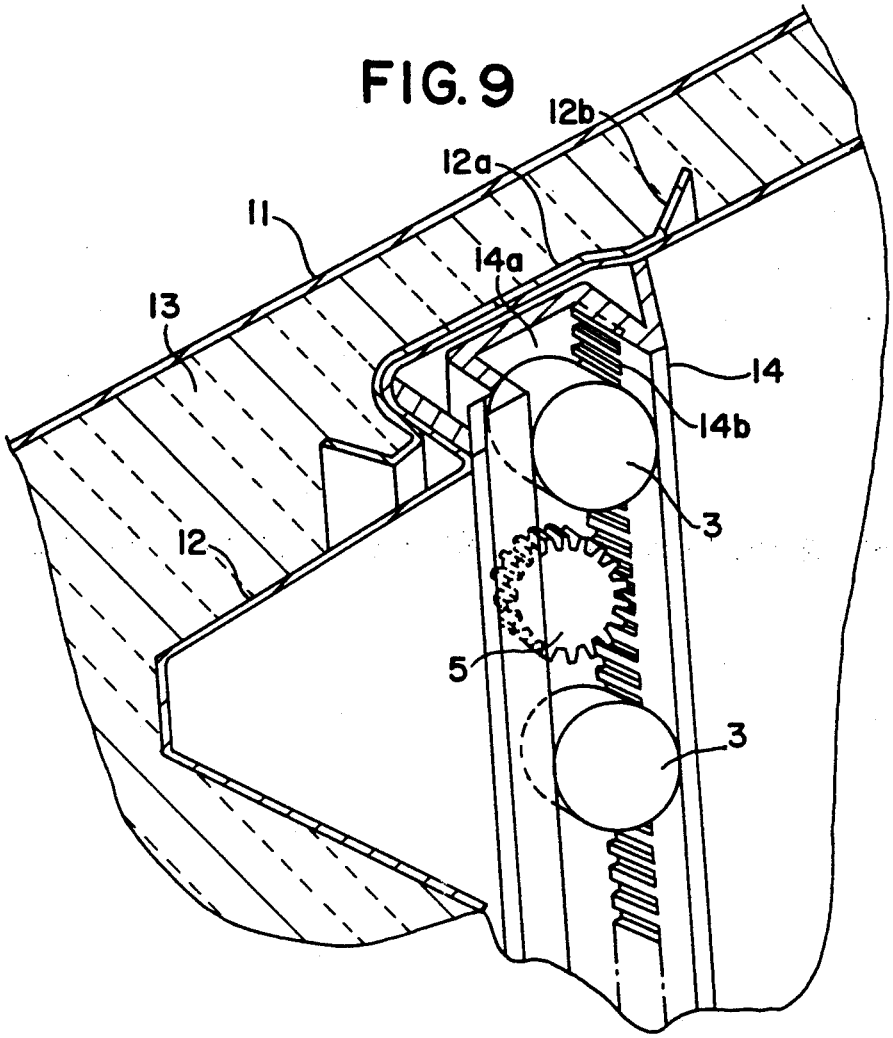
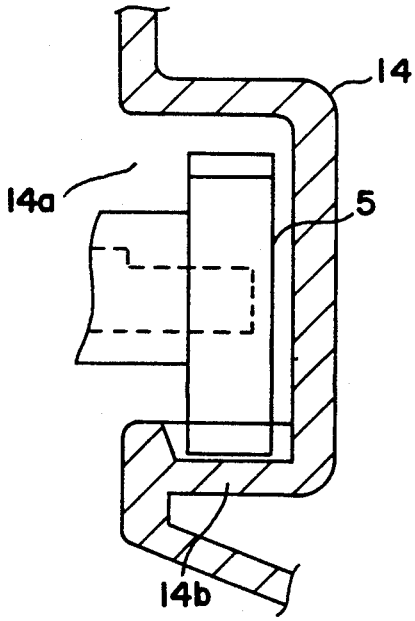
FIG. 10
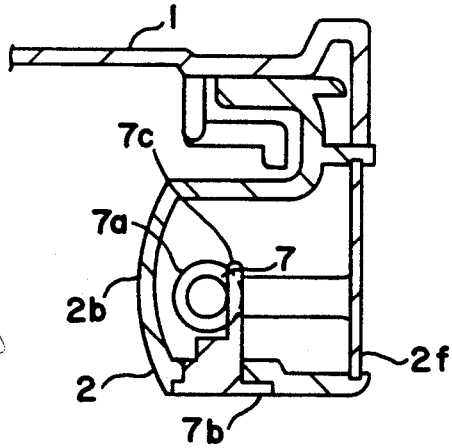
FIG. 11

SHELF APPARATUS FOR A REFRIGERATOR

BACKGROUND OF THE INVENTION

1. Field of the Invention

The present invention relates to a shelf apparatus which will raise and lower refrigerator's food storage shelves in an analog manner.

2. Description of the Prior Art

In recent years, a great variety of different things are stored in refrigerators. For example, prepared foods are refrigerated in large salad bowls or on plates etc., and large uncut vegetables, fruits or the like are refrigerated just as they are.

In this case, to secure space for storing large items of food and the like, it is necessary to increase the capacity of storage space between one storage shelf and another storage shelf inside a refrigerator (hereinafter, referred to as storage space). In the prior art, in order to increase the capacity of storage space, it is common that a plurality of rails parallel to a horizontal plane provided on opposing side walls of a refrigerator's interior to support storage shelves are employed, and then the positions for inserting the storage shelves are changed.

However, the above-mentioned means of the prior art makes it necessary to first remove all of the food etc. on the storage shelves in order to change the positions at which the storage shelves are inserted, and this is inconvenient.

Furthermore, since each position is fixed for a plurality of rails which support the storage shelves, an increase or decrease in capacity of the storage space becomes uniform, and hence there is a problem of not being able to increase or decrease the capacity corresponding to the size of each food etc.

The U.S. Pat. No. 2841459 discloses a means for solving the above-mentioned problem. This conventional shelf apparatus for a refrigerator comprises shelves arranged inside a refrigerator, frames for holding the shelves, two rails for sustaining the sliding of rollers which are supported at the left and right of the frame, and a jackscrew for fixing the frame at desired positions. The frame holds a nut engaged with the jackscrew and a shaft with a handle for rotating the nut so that they can rotate freely. Furthermore, the rails are vertically installed at the left and right rear of the refrigerator's interior, and the screwjack is vertically installed at the rear center of the refrigerator's interior. Then, the position of the frame for holding the shelf is changed by turning the shaft with a handle, which rotates the nut engaged with the jackscrew, and thereby changes the position of the nut.

The above-mentioned shelf apparatus for a refrigerator has a construction in which the position of the frame for holding the shelf is raised and lowered by the jackscrew installed at the rear center of the refrigerator's interior, and when food is placed on the shelf, particularly when the load is lopsided on either left or right, the shelf tilts to the side on which most of the food is placed and the rollers contact the rails at an angle, so that they do not rotate smoothly, making it necessary to turn the shaft with a handle using a great deal of force. Furthermore, the shaft with a handle, jackscrew and so forth are in the center portion of the shelf, and this structure is comparatively large, it becomes an obstruction to the placement of food on the food storage surface of a lower shelf or the bottom tier.

Furthermore, when a frame reaches the top or bottom of the refrigerator's interior, or when a plurality of them are provided and there are collisions between the frames, and when the dial shaft is over-loaded, there is a problem of the handle causing damage to the shaft.

SUMMARY OF THE INVNETION

The shelf apparatus for a refrigerator of the this invention, which overcomes the above-discussed and numerous other disadvantages and deficiencies of the prior art, has a pair of vertically extending rails, each of the rails situated generally at the intersection of a side wall and the rear wall and having a vertically extending slide groove with slide surfaces on front and rear sides of the slide groove; a pair of racks, each of said racks formed on one of the slide grooves and having a vertically extending row of teeth; at least one shelf having at each opposite end abutting said side walls an engaging gear, an upper sliding member and a lower sliding member, each of said engaging gears engaging a portion of the row of teeth in one of the racks, each of the upper sliding members disposed above the engaging gear, and sliding on one of the slide surfaces in the slide groove, each of the lower sliding members disposed below the engaging gear and sliding on one of the slide surfaces in the slide groove, so that the shelf moves upward and downward along the slide grooves in a horizontal position; and a drive mechanism mounted to the shelf for rotating the engaging gears.

In a preferred embodiment, the upper and lower sliding members are rollers.

In a preferred embodiment, the drive mechanism includes a drive shaft for transferring rotational movement to the engaging gears.

In a preferred embodiment, the drive mechanism includes a disengaging section for disengaging the drive shaft from the engaging gears when the drive shaft is subjected to a torque exceeding a certain amount.

In a preferred embodiment, the drive mechanism includes a worm gear connected to the drive shaft.

In a preferred embodiment, the engaging gears are connected in fixed rotational relation relative to one another by a gear shaft.

In a preferred embodiment, the drive mechanism includes a rolling gear mounted on the gear shaft for transferring rotational movement from the worm gear to the pair of engaging gears.

In a preferred embodiment, the drive mechanism includes a dial connected to the drive shaft.

In a preferred embodiment, the drive mechanism is substantially housed in a frame.

Thus, the invention described herein makes possible the objective of providing a shelf apparatus for a refrigerator which raises and lowers refrigerator's food storage shelves in an analog manner, thereby determining the positions of the shelves largely in accordance with the size of food items stored inside the refrigerator.

BRIEF DESCRIPTION OF THE DRAWINGS

This invention may be better understood and its numerous objects and advantages will become apparent to those skilled in the art by reference to the accompanying drawings as follows:

FIG. 7 is a cross-sectional view showing the engaging parts of the dial shaft and drive gear, wherein FIG. 7(*a*) is a cross-sectional view showing a normal engaged condition and FIG. 7(*b*) is a cross-sectional view showing a skidding condition resulting from an overload;

FIG. 8 is a perspective view showing the engaging parts of the dial shaft and drive gear when overloaded;

FIG. 9 is a cross-sectional, perspective view showing main portions of a rail section;

FIG. 10 is an enlarged cross-sectional view of main portions showing the engagement of a flat gear and rack;

FIG. 11 is a cross-sectional view taken along line B—B of the refrigerator shown in FIG. 1;

DESCRIPTION OF THE PREFERRED EMBODIMENTS

Figure 1:
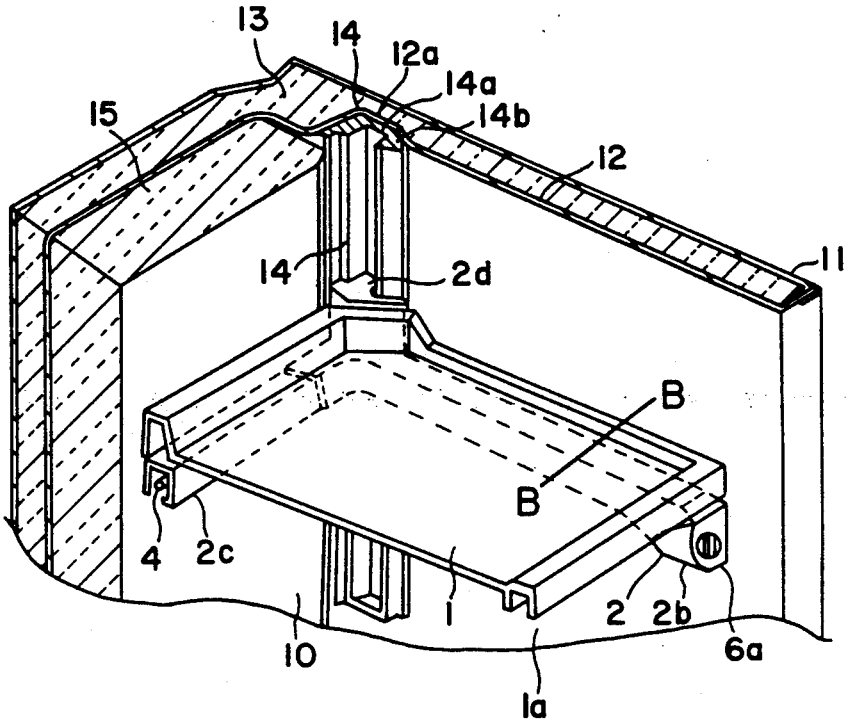
FIG. 1 is a cross-sectional, perspective view showing a refrigerator in which a first example of the present invention is applied.
Figure 2:
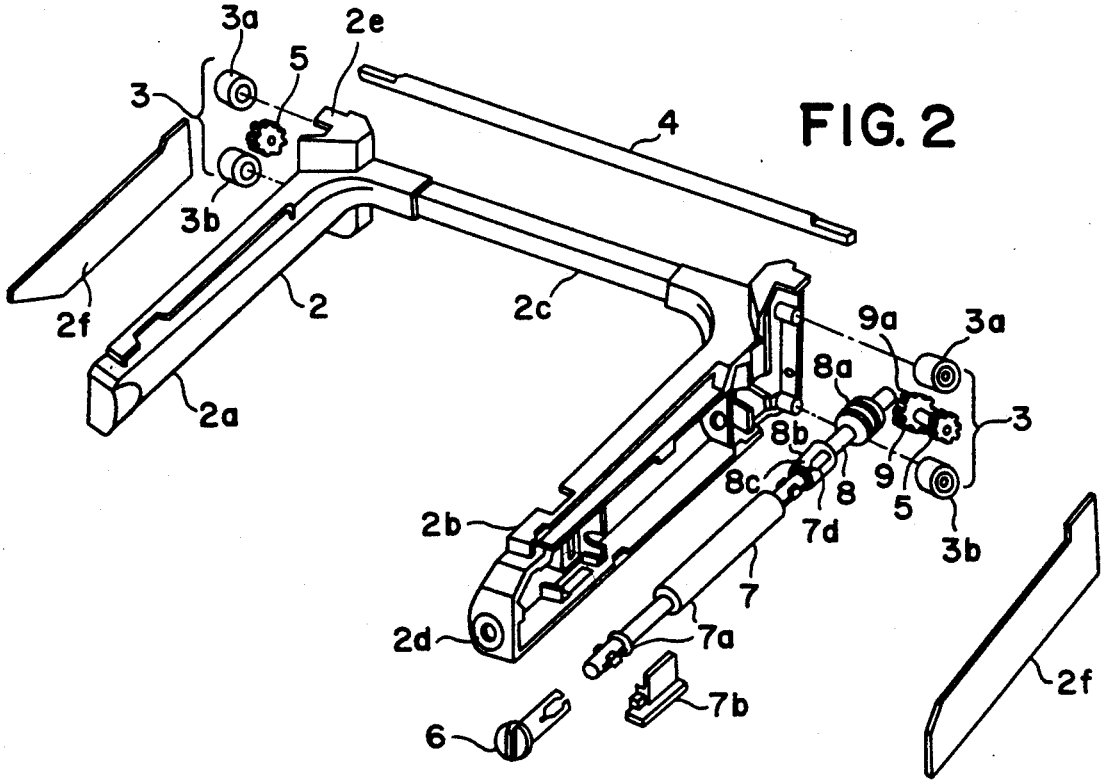
FIG. 2 is an exploded perspective view showing a frame which is used in this example.
Figure 3:
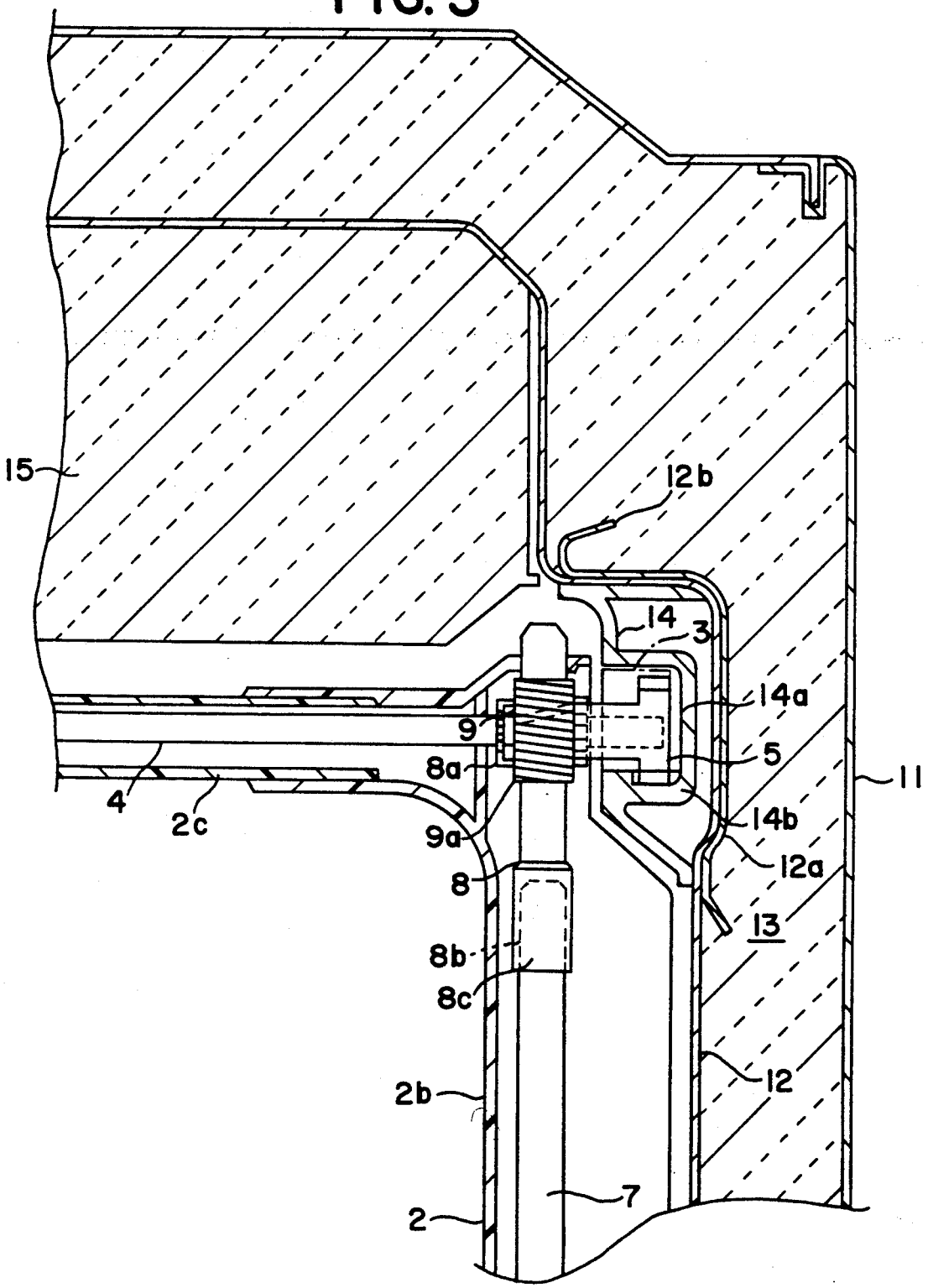
FIG. 3 is an enlarged cross-sectional view showing main portions of this example.

The present invention will be described by way of illustrating the first example with reference to FIGS. 1 to 12.

In the figures, the reference numeral 1 denotes a food storage shelf upon which food is placed. A frame 2 which supports the shelf 1 is formed from a left frame 2*a*, a right frame 2*b*, and a rear frame 2*c* which connects these left and right frames 2*a* and 2*b*. A shelf unit 1*a* is composed of the food storage shelf 1 and the frame 2. Flanges 2*e* are formed protruding from the left and right upper edges of the frame. Sliding members 3 are installed at the left and right rear of the frame 2, and comprise upper and lower rollers 3*a* and 3*b*. Furthermore, the upper and lower rollers 3*a* and 3*b* are each installed on metal roller shafts 3*c* so that they rotate freely. A gear shaft 4 is installed at the rear of the frame 2 so that it rotates freely, and flat gears 5 fixed to the left and right ends are installed. A dial 6 is installed in a dial aperture 2*d* at the front of the right frame 2*b* so that it rotates freely, and a dial shaft 7 is connected to this dial 6. A stopper section 7*a* is provided on this dial shaft 7, and a stopper shaft 7*b* inserted from the bottom of the frame 2*b* and fixed in the stopper interval is inserted and positioned after the installation of the dial shaft 7. A boss section 7*c* is formed at the end of the dial shaft 7, which has a plurality of projections 7*d*.

A drive gear 8 is usually called a worm gear, one end of which is in a screw shape and the other end of which comprises a boss receiving portion 8*b* having a hollow flange 8*c* that engages with the boss section 7*c*. The drive gear 8 is rotated by engaging with the dial shaft 7, which is rotated by the operation of the dial 6.

Furthermore, since a notch is provided at the open end of the flange 8*c*, when the rotation of the dial shaft 7 is overloaded, the projections 7*d* on the boss section 7*c* of the dial shaft 7 push the flange 8*c* apart and the dial shaft 7 begins to skid, as shown in FIGS. 7(*a*) and 7(*b*).

Figure 4:
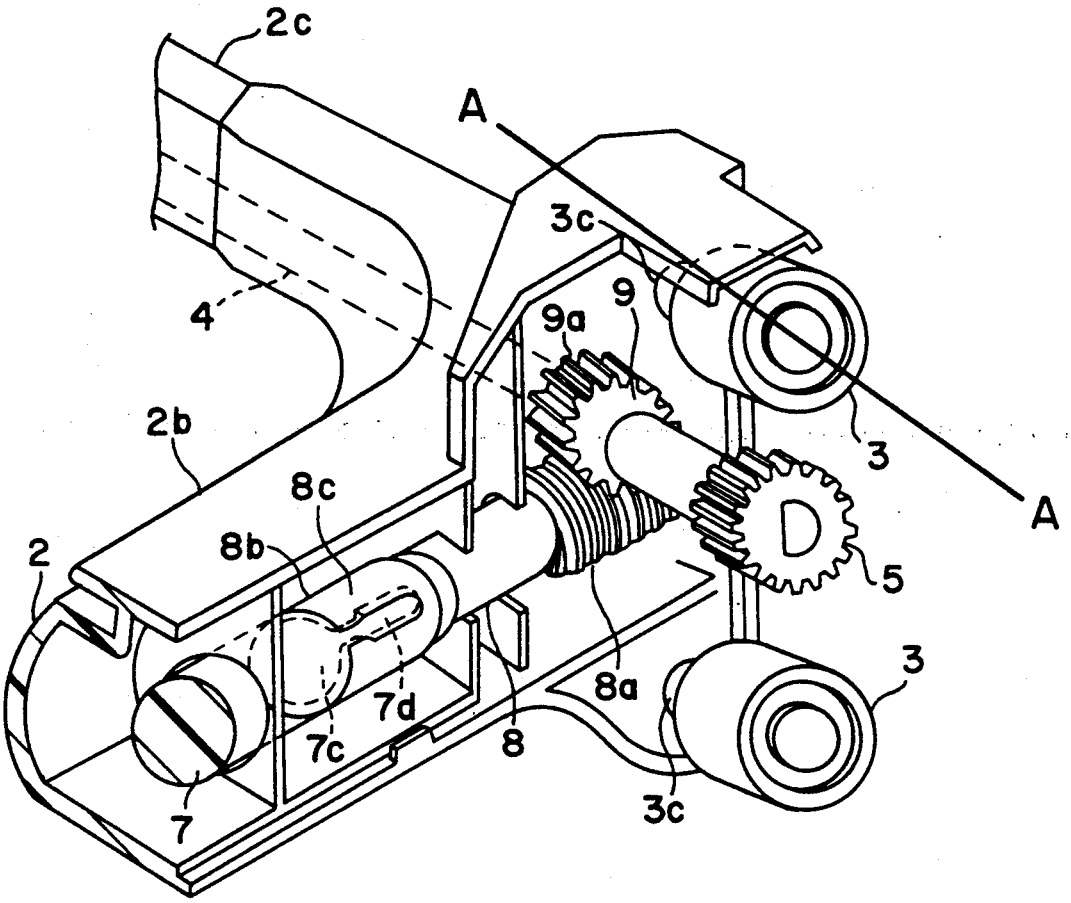
FIG. 4 is an enlarged perspective view showing main portions of this example.
Figure 5:
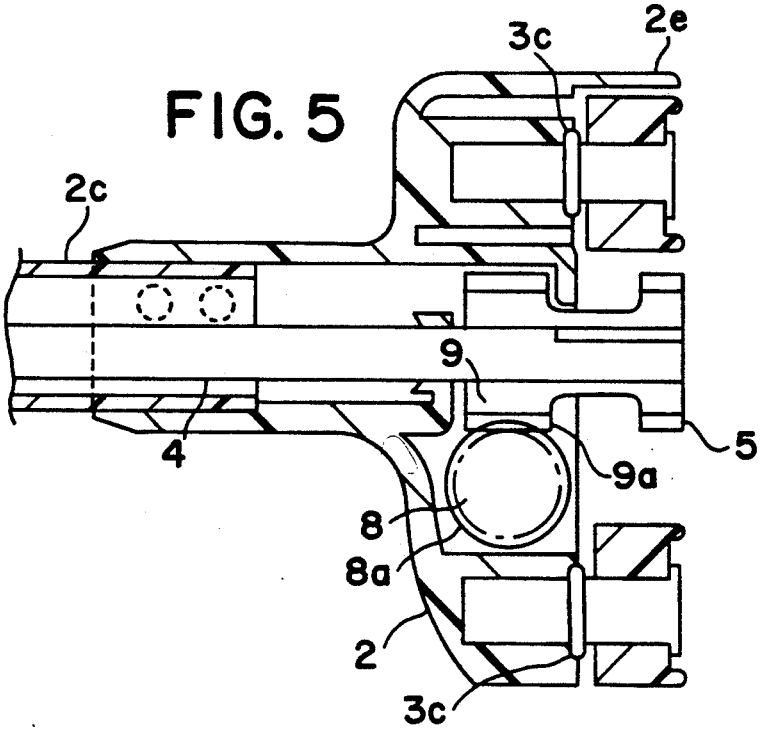
FIG. 5 is a cross-sectional view taken along line A—A in FIG. 3.
Figure 6:
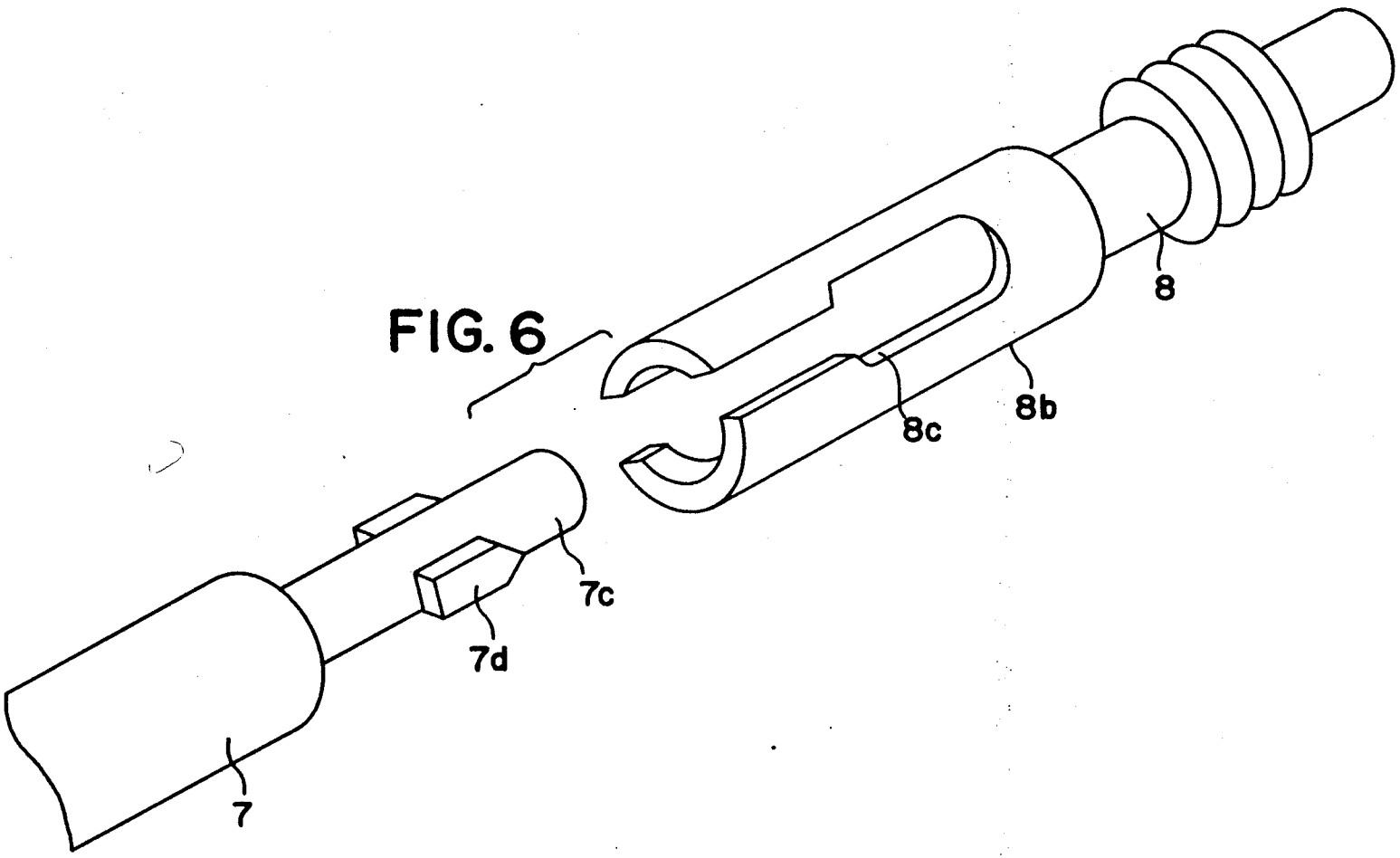
FIG. 6 is an exploded perspective view showing a dial shaft and drive gear prior to engagement.
Figure 12:
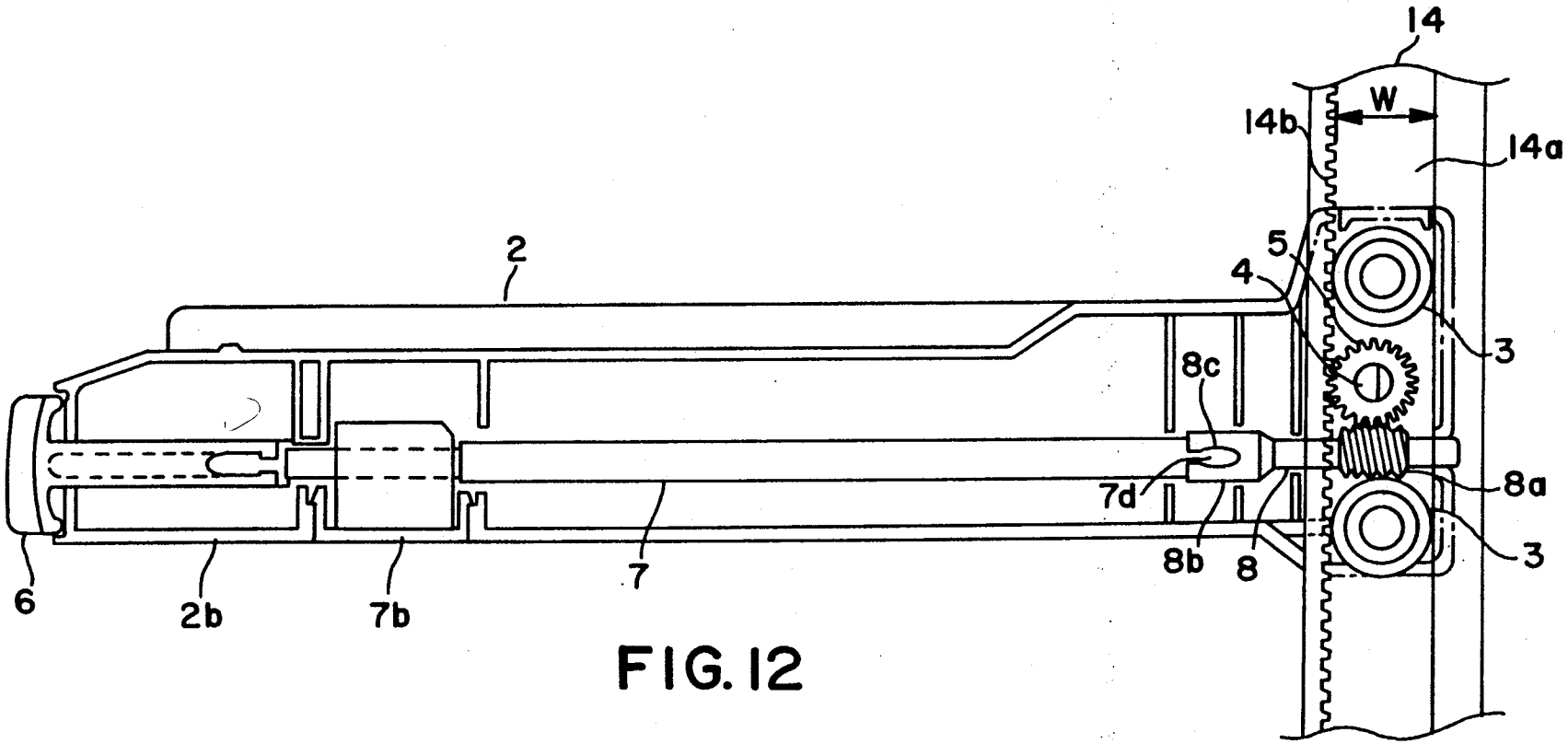
FIG. 12 is a cross-sectional view showing main portions of a right frame viewed from a side surface.

A rolling gear 9 is usually called a worm wheel, which comprises teeth 9*a* at an angle with respect to the rotation axis, that is, the gear shaft 4 so as to engage with screw-shaped teeth 8*a* of the drive gear 8 and is fixed to the gear shaft 4 adjacent to the flat gear 5 on the right side (it can be integral with the flat gear 5). Furthermore, cover frames 2*f* cover the open faces of the frames 2*a* and 2*b* after all of the gears have been installed. The reference numerals 10 and 11 denote an interior of a refrigerator and an exterior cabinet made of a metal plate of a refrigerator body. An interior cabinet 12 made of resin comprises grooves 12*a* for rails formed at the intersection of a side wall and a rear wall of the refrigerator's interior. A foam heat insulating material is foam packed between the exterior cabinet 11 and the interior cabinet 12. A rail 14 is fixed to the rail groove 12*a* of the interior cabinet 12 by means of screws or the like. An installation reinforcing plate 12*b* for the rail 14 is installed through the interior cabinet 12. The rail 14 comprises a slide groove 14*a* which accepts at least part of the flat gear 5, sliding members 3, that is, the upper roller 3*a* and the lower roller 3*b*, and sustains their sliding. A rack 14*b* having a vertically extending row of teeth is formed in the inner front side of the slide groove 14*a* of the rail 14, and a portion of the row of teeth of the rack 14*b* engages with the flat gear 5. Moreover, the width "w" of the slide groove 14*a* is approximately 0.1 to 1 mm larger than the outer diameter of the upper roller 3*a* and the lower roller 3*b*. Furthermore, the upper rollers 3*a*, the lower rollers 3*b* and the flat gears 5 are positioned on approximately the same lines, and they are disposed in the left frame 2*a* and the right frame 2*b* so as to position the upper rollers 3*a* above the flat gears 5 and the lower rollers 3*b* below the flat gears 5, respectively, so that the upper rollers 3*a* contact the front surfaces of the slide grooves 14*a*, the lower rollers 3*b* contact the rear surfaces of the slide grooves 14*a*, and the flat gears 5 engage with a portion of the row of teeth of the racks 14*b*. Furthermore, in this example, the frame 2 is formed so that it covers the flat gears 5, drive gear 8, rolling gear 9 and so forth from the interior of the refrigerator as shown in FIG. 4. The flanges 2*e* formed at the upper ends of the frame 2 and providing narrow openings between themselves and the slide grooves 14*a* of the rails 14 cover the upper rollers 3*a* and the flat gears 5. A control panel 15 is provided with air ducts and the like inside thereof for cooling the interior 10 of the refrigerator.

When moving the shelf unit 1*a* of the shelf apparatus for the refrigerator of this example up or down, first of all, the dial shaft 7 and drive gear 8 are rotated by rotating the dial 6. Accordingly, the rolling gear 9 which engages with the drive gear 8 rotates, thereby rotating the gear shaft 4 and the flat gears 5 on both ends thereof. Then, through the gear shaft 4, the flat gears 5 move while engaging a portion of the row of teeth of the racks 14*b* on the inner front surfaces of the slide grooves 14*a*, and since the left and right flat gears 5 are fixed to the gear shaft 4 and rotate in the same way, the left and right sides of the shelf unit 1*a* move up and down at the same distance and thus a difference in height between the left and right sides does not occur. Due to this, the sliding members 3 which move up and down within the slide grooves 14a do not tilt and are able to slide smoothly, thereby making it possible to operate the dial 6 with a small amount of physical force. In this example, the roller shafts 3c for the upper and lower rollers 3a and 3b are made of metal so that, even when a large amount of food is loaded onto the shelf unit 1a, the upper and lower rollers 3a and 3b do not tilt, and since they rotate smoothly while making it possible to reduce frictional force, the dial 6 can be operated with extremely little physical force. When the shelf unit 1a is stopped after being moved to the desired position by the dial 6, the shelf 1, that is, frame 2 tend to drop due to the weight of the shelf unit 1a, frame 2 and the food loaded on the shelf 1. The flat gears 5 tend to rotate due to this force. Accordingly, the gear shaft 4 and the rolling gear 9 tend to rotate. The rolling gear 9 is engaged with the drive gear 8, so that it is dynamically easy to rotate the rolling gear 9 by rotating the drive gear 8. On the other hand, in order to rotate the drive gear 8 by means of the rolling gear 9, an extremely large torque is required due to the teeth ratio between both gears, so that the rolling gear 9 does not rotate the drive gear 8. Accordingly, when the shelf 1 is stopped, the drive gear 8 and the rolling gear 9 perform the function of a stopper mechanism, and thus even when food is loaded onto the shelf 1, the shelf unit 1a does not drop, thereby maintaining the position. Since the upper rollers 3a, the lower rollers 3b and the flat gears 5 are positioned at the rear of the frame 2 in the same vertical direction, so as to position the upper rollers 3a above the flat gears 5 and the lower rollers 3b below the flat gears 5 and make a gap between the flat gears 5 and the upper rollers 3a narrower than that between the flat gears 5 and the lower rollers 3b as the load on the shelf unit 1a becomes larger, the upper rollers 3a make better contact with the front surfaces of the slide grooves 14a, the lower rollers 3b make stronger contact with the rear surfaces of the slide grooves 14a, and the flat gears 5 engage more strongly with a portion of the row of teeth of the racks 14b. Their frictional forces of rotation become greater, the frame 2 which holds the food storage shelf 1 is maintained at a predetermined position without dropping or tilting the shelf unit 1a.

As described above, a shelf apparatus for a refrigerator of this example does not require a large force to move the shelf unit 1a, even with food loaded onto it, and tilting of the shelf 1 does not occur. Furthermore in this example, when the frame 2 is positioned at the top or bottom of the refrigerator's interior, problems caused by an overload on the dial shaft 7, such as contact of food with the wall surfaces of the refrigerator's interior, deformation of the food storage shelf 11, or breaking of the frame 2 and the drive gear 8 can be prevented, because a flange 8b of the drive gear 8 spreads apart as in FIG. 8, allowing the dial shaft 7 to skid.

Figure 13:
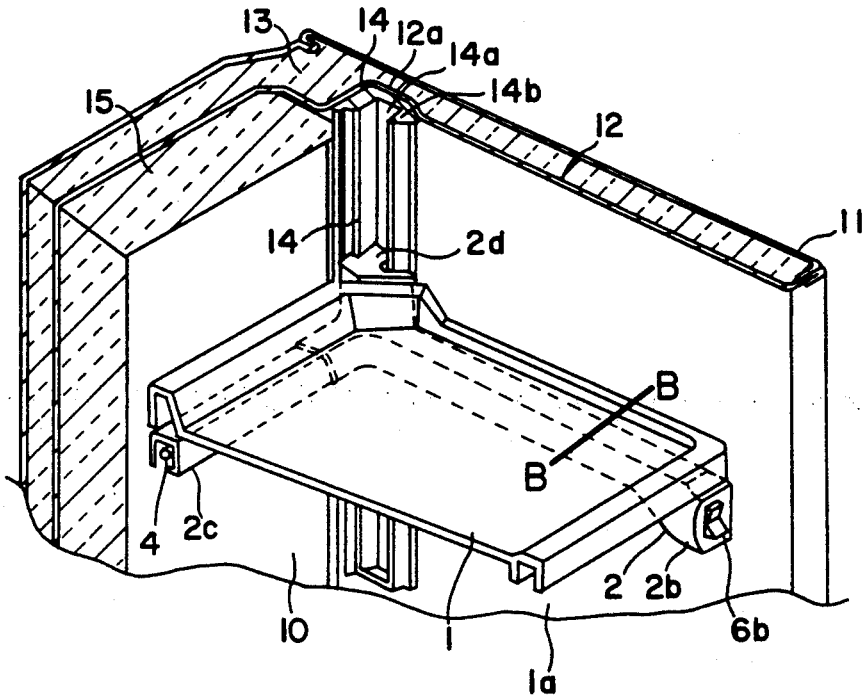
FIG. 13 is a cross-sectional, perspective view showing a refrigerator in which a second example of the present invention is applied.
Figure 14:
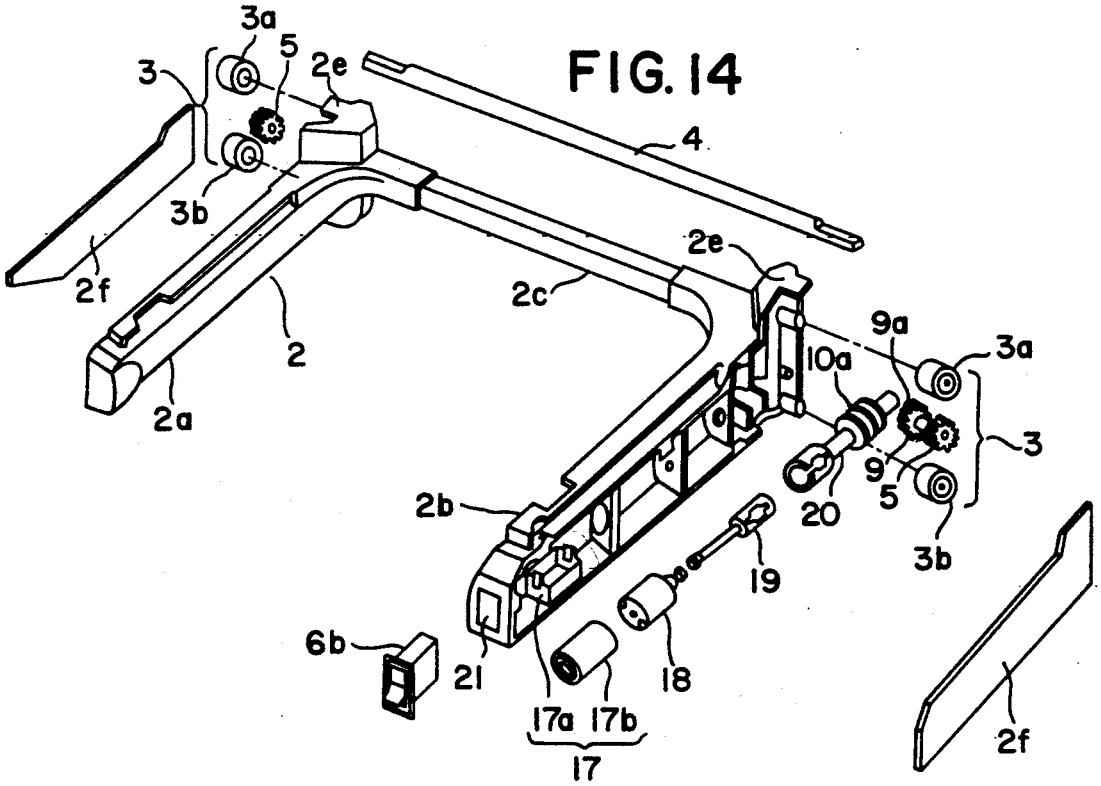
FIG. 14 is an exploded perspective view showing a frame used in this example.
Figure 15:
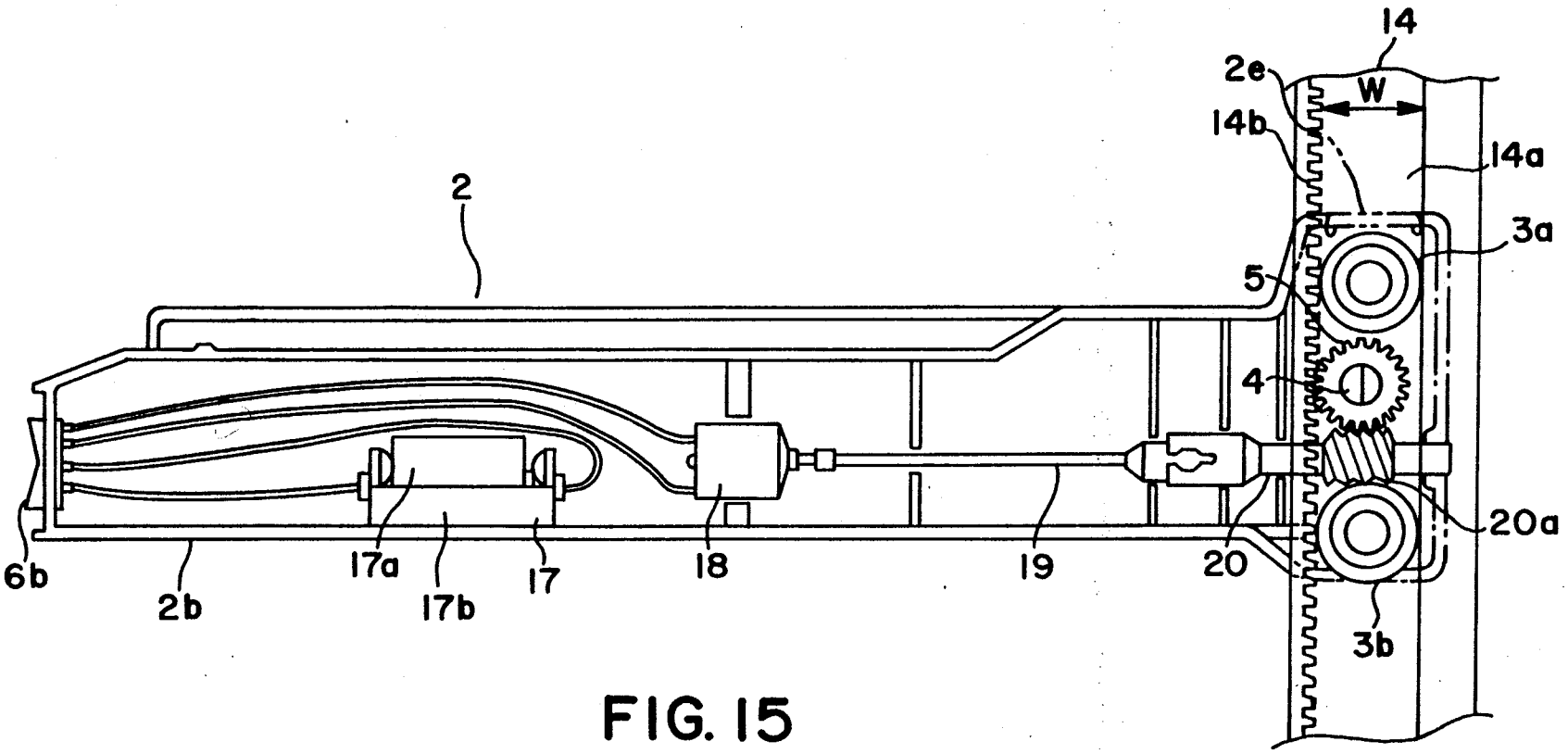
FIG. 15 is a cross-sectional view showing main portions of a right frame in this example viewed from a side surface.

Next, a second example of the present invention will be described with reference to FIGS. 13 to 15. Description will be omitted for portions, the structure of which, is the same as that of the first example.

In the figures, the reference numeral 6b is a control switch installed in a switch aperture 21 in the front part of a right frame 2b; 18 an electric motor which moves a shelf upward and downward; and 17 a power supply apparatus comprising a battery 17a and a battery box 17b, and composing a circuit with the control switch 6b, which switches normal rotation, reverse rotation and stopping of the electric motor, and the electric motor 18. A drive shaft 19 is connected to the electric motor 18, and a drive gear 20 is usually called a worm gear, which is fixed to this drive shaft 19 and is formed with screw shaped-teeth 20a. A rolling gear 9 is usually called a worm wheel, fixed to a gear shaft 4 adjacent to a flat gear 5 on the right side, which is formed with teeth 9a that are at an angle with respect to the axis of rotation, that is, the gear shaft 4 so as to engage with screw-shaped teeth 20a of the drive gear 20.

When moving the shelf unit 1a of the shelf apparatus for a refrigerator up and down, first of all, the electric motor 18, the drive shaft 19 and the drive gear 20 are rotated by pressing the control switch 6a. Accordingly, the rolling gear 9 which engages with the drive gear 20 rotates, thereby rotating the gear shaft 4 and the flat gears 5 on both ends thereof. Then, through the gear shaft 4, the flat gears 5 move while engaging with the racks 14b on the inner front surfaces of the slide grooves 14a, and since the left and right flat gears 5 are fixed to the gear shaft 4 and have the same rotation, the shelf unit 1a is moved up and down at the same distance on the left and right, and thus a difference in height between the left and right does not occur. Due to this, the sliding members 3 which move up and down within the slide grooves 14a do not tilt and are able to slide smoothly. Furthermore, in this example, the roller shafts 3c for the upper and lower rollers 3a and 3b are made of metal, so that even when a large amount of food is loaded onto the shelf unit 1a, the upper and lower rollers 3a and 3b do not tilt, and since they rotate smoothly while making it possible to reduce frictional forces, the burden on the electric motor 18 is small. When the shelf 1 is stopped after being moved to the desired position by the electric motor 18, the shelf unit 1a tends to drop due to the weight of the shelf unit 1a itself and the food on it. The flat gears 5 tend to rotate due to this force. Accordingly, the gear shaft 4 and the rolling gear 9 tend to rotate. The rolling gear 9 is engaged with the drive gear 20, so that it is dynamically easy to rotate the rolling gear 9 by rotating the drive gear 20. On the other hand, in order to rotate the drive gear 20 by means of the rolling gear 9, extremely large torque is required due to the teeth ratio between both gears, so that the rolling gear 9 does not rotate the drive gear 20. Accordingly, when the shelf 1 is stopped, the drive gear 20 and the rolling gear 9 perform the function as a stopper mechanism, and thus even when food is loaded on the shelf unit 1a, it does not drop, thereby maintaining the position. Since the upper rollers 3a, the lower rollers 3b and the flat gears 5 are positioned at the rear of the frame 2 in the same vertical direction, as the load on the shelf unit 1a becomes larger, the upper rollers 3a make better contact with the front surfaces of the slide grooves 14a, the lower rollers 3b make stronger contact with the rear surfaces of the slide grooves 14a, the flat gears 5 engage more strongly with the racks 14b. Their frictional forces of rotation become greater, the frame 2 which holds the shelf unit 1a is maintained at a predetermined position without dropping or tilting of the shelf unit 1a.

As described above, a shelf apparatus for a refrigerator of this example does not require a large force to move the shelf unit 1a, even with food loaded on it, and tilting of the shelf 1 does not occur. Moreover in this example, there is no problem such as damage to the gears and so forth caused by food bumping into them, since the right frame 2b covers the drive shaft 19, the drive gear 20, the rolling gear 9 and the flat gear 5, while the sliding members 3 are covered by the flanges 2e provided on the upper left and right parts of the frames 2a and 2b, the gear shaft 4 is covered by the rear frame 2c, and the flat gears 5 are covered by the flanges 2e and the left and right frames 2a and 2b. There is also no problem such as interference with food stored on a lower level. Furthermore, since the racks 14b are formed on the inner wall of the slide grooves 14a so that they cannot be seen from the front of the refrigerator's interior, a superior outward appearance is created, and a reduction of the rail size is achieved. The width of the slide grooves 14a, which sustain the sliding of the upper rollers 3a and the lower rollers 3b, is just a little larger than the outer diameter of the upper rollers 3a and the lower rollers 3b, and because the upper rollers 3a and the lower rollers 3b are inserted into the slide grooves 14a with a vertical separation between them, even if the bottom surface of the shelf 1 is pushed upward by food, the upper rollers 3a will contact the rear surfaces of the slide grooves 14a and the lower rollers 3b will contact the front surfaces of the slide grooves 14a, and therefore any displacement of the shelf unit 1a will be small.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A shelf apparatus in a refrigerator having a rear wall and opposing side walls, comprising:

a pair of vertically extending rails, each of said rails situated generally at the intersection of a side wall and the rear wall and having a vertically extending slide groove with opposed slide surfaces;

a pair of racks, each of said racks formed on one of said slide grooves and having a vertically extending row of teeth;

at least one horizontally-oriented shelf having a rear edge and opposed side edges abutting said rear wall and said side walls respectively, each said shelf having a support assembly at the intersection of each side edge and rear edge including an engaging gear, an upper sliding member and a lower sliding member, each of said engaging gears engaging a portion of said row of teeth in one of said racks, each of said upper sliding members disposed above said engaging gear and sliding on one of said slide surfaces in said slide groove, each of said lower sliding members disposed below said engaging gear and sliding on one of said slide surfaces in said slide groove, so that said shelf is vertically moved when said support assembly moves upwardly and downwardly along said rails; and a drive means mounted to said shelf for rotating said engaging gears to move said shelf.

2. A shelf apparatus for a refrigerator according to claim 1, wherein said upper and lower sliding members are rollers.

3. A shelf apparatus according to claim 1, wherein said drive means is substantially housed in a frame.

4. A shelf apparatus for a refrigerator according to claim 1, wherein said drive means includes a drive shaft for rotating to said engaging gears.

5. A shelf apparatus according to claim 4, wherein said drive means includes disengaging means for disengaging said drive shaft from said engaging gears when said drive shaft is subjected to a torque exceeding a certain amount.

6. A shelf apparatus according to claim 4, wherein said drive means includes a worm gear connected to said drive shaft.

7. A shelf apparatus according to claim 4, wherein said drive means includes a dial connected to said drive shaft.

8. A shelf apparatus according to claim 4, wherein said engaging gears are connected in fixed rotational relation relative to one another by a gear shaft.

9. A shelf apparatus according to claim 8, wherein said drive means includes a rolling gear mounted on said gear shaft for transferring rotational movement from said worm gear to said engaging gears.

10. A shelf apparatus in a refrigerator according to claim 1, wherein the support assembly consists of a rolling gear for rotating the gears which engage the racks and a drive gear for rotating the rolling gear, and said drive means consists of a motor for rotating the drive gear, and a control switch for controlling the ON and OFF states of the motor.

11. A shelf apparatus in a refrigerator according to claim 10, wherein said drive gear is a worm gear and said rolling gear is a worm wheel.

* * * * *